US005549226A

United States Patent [19]

Kopp

[11] Patent Number: 5,549,226

[45] Date of Patent: Aug. 27, 1996

[54] DEVICE FOR OPERATING DEVICES FOR PROPELLANT CANS

[76] Inventor: Volker Kopp, Santisstrasse 29, CH-8133 Esslingen, Switzerland

[21] Appl. No.: 231,611

[22] Filed: Apr. 22, 1994

[30] Foreign Application Priority Data

Apr. 23, 1993 [DE] Germany ..... 43 13 319.3

[51] Int. Cl.[6] ..... B65D 83/30

[52] U.S. Cl. ..... 222/402.13; 222/402.15; 222/528; 222/529; 222/530

[58] Field of Search ..... 222/402.13, 402.15, 222/528, 529, 530

[56] References Cited

U.S. PATENT DOCUMENTS

| | | | |
|---|---|---|---|
| 470,776 | 3/1892 | Beehler | 222/529 |
| 2,770,399 | 11/1956 | Gross | 222/530 X |
| 3,146,916 | 9/1964 | Kronheim | 222/402.13 X |
| 3,181,743 | 5/1965 | Libit et al. | 222/528 |
| 3,392,838 | 8/1968 | Beres et al. | 222/528 X |
| 3,392,887 | 7/1968 | Bross | 222/528 |
| 4,453,653 | 6/1984 | Chapelsky et al. | 222/528 |
| 4,941,600 | 7/1990 | Berviochoa et al. | 222/402.13 |
| 5,203,841 | 4/1993 | Kitabayashi | 222/530 X |

FOREIGN PATENT DOCUMENTS

| | | | |
|---|---|---|---|
| 212738 | 5/1960 | Austria | 222/530 |
| 91114634.8 | 8/1991 | European Pat. Off. . | |
| 1215061 | 4/1960 | France | 222/530 |
| 0676354 | 1/1991 | Switzerland | B65D 83/44 |

*Primary Examiner*—Andres Kashnikow
*Assistant Examiner*—Kenneth Bomberg

[57] ABSTRACT

The outlet tubes of pressurized cans containing, for example, polyurethane which is to be foamed, very frequently become clogged. The unconsumed residue of the substance intended to be dispensed consequently becomes unusable. This is prevented in accordance with the invention by the use of tubes which are sufficiently stiff to enable them to be folded back over themselves to form a solvent-tight pinch fold, in which folded-back position the tube is held by a holding device. In addition, the free end of the tube can also be closed.

28 Claims, 3 Drawing Sheets

Fig. 3
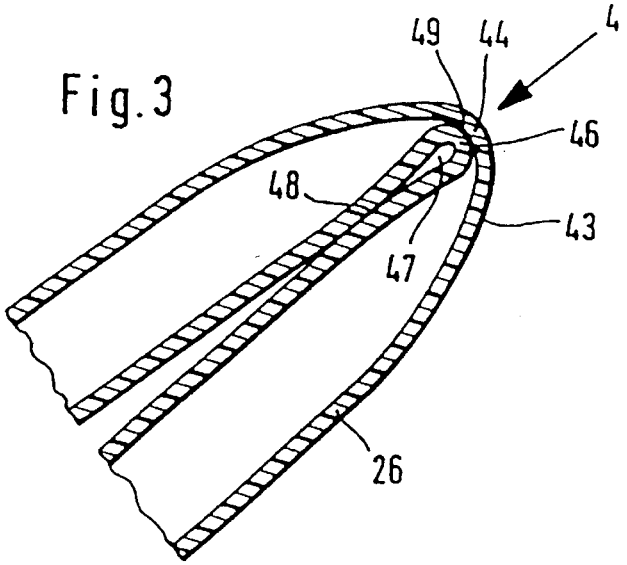
Fig. 4
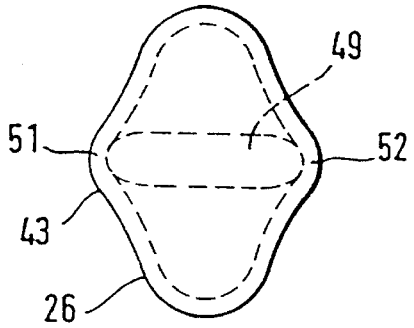
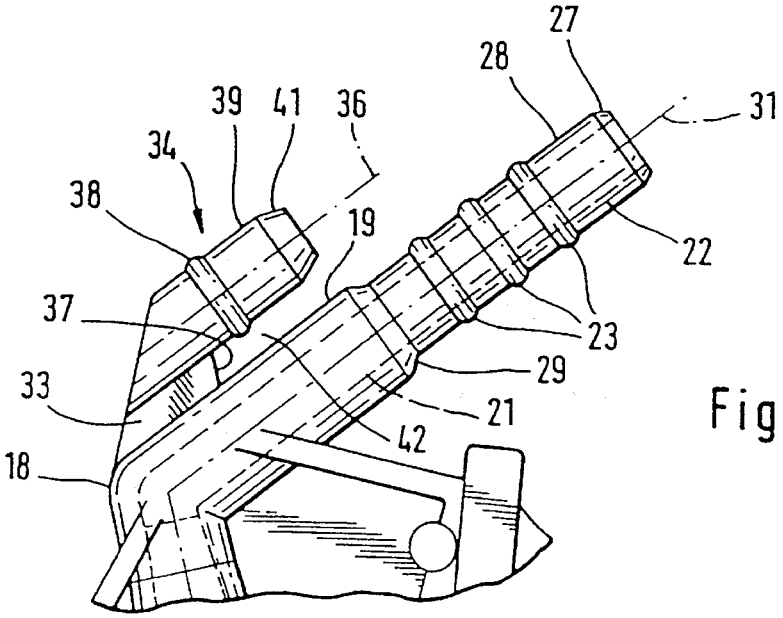
Fig. 5
Fig. 6
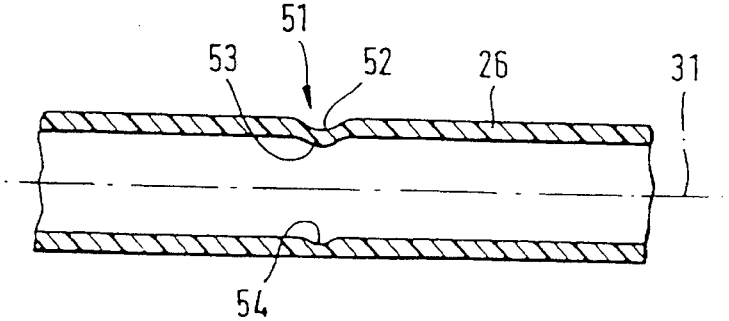

DEVICE FOR OPERATING DEVICES FOR PROPELLANT CANS

BACKGROUND OF THE INVENTION

1. Field of the Invention

The invention relates to a device for the region of cans held under propellant pressure where liquid to pasty substances containing solvent pass out, including an operating device for delivering the substances.

It is known to store substances initially in cans, in which they are held under pressure. This pressure can be produced in various ways, for example by means of a propellant gas, bladders under internal pressure, pistons under spring pressure, or the like. When an operating device is operated, the substance passes out into the atmosphere. For this purpose, a spring-loaded button is pressed. A part of this actuating device can also be tilted by pulling a lever 36, so that the substance passes out of the tube 37, as described in European Patent Application 91 114 634.8. The substances may, for example, be lacquers, lubricants and, in particular, substances which in the air harden to a foam.

2. Discussion of Prior Art

It has become possible, in accordance with Swiss Patent Document CH-PS 676 354, to produce the valve part of the operating device without rubber or other comparable substances. Such devices can consequently be stored and transported even in a horizontal position. However, the weakest link in the chain is still the region downstream of the valve. The substance, particularly the one which subsequently forms the polyurethane foam, can there form a clot. Although the problems in the valve region have been overcome, it is therefore possible to use the can only once if the substance contained in the so-called stem loses solvents through evaporation. In addition, moisture can pass from the interior to the exterior of the device, and also in particular from the exterior to the interior.

Particularly in the field of hobbies it is known that small amounts of substances are needed. If larger amounts are bought, this is detrimental in various respects: more than is needed is bought. The unused residues must be disposed of as special refuse. To some extent this is also the case when smaller cans are produced. It would, however, be more advantageous also to make larger cans available for hobby purposes, provided they can be used until they are quite empty. It would be ideal if, over a long period of time, it were possible to use the can at the end of its life in exactly the same way as when it is fresh from the factory.

If the substance has already solidified in the stem, it is also possible that when the valve is subsequently operated a number of times, solidified material will also pass into the valve, so that the latter itself will leak. Even if the removable part of the operating device were to be cleaned, the leaking valve could in the meantime have entirely or to a substantial extent destroyed the pressure in the can.

SUMMARY OF THE INVENTION

The object of the invention is to provide in a very simple manner, even for not very technically minded people, a design to keep the substance fresh, that is to say in a usable state, even downstream of the valve. This should be possible in an inexpensive, repeatable and simple manner. According to the invention, this object is achieved by the following features:

An outlet connection piece is provided on the operating device that delivers the substance. A tube with at least a region that is resilient and flexible is mounted vapor-tight on an end region of the outlet connection piece. The tube itself consists of vapor-tight material. The tube can be bent back over itself to form a pinch fold. A holding device is provided on the outlet connection piece, which holds the tube in the bent back over position, such that it can be detached from the holding device by hand. The pinch fold is at least substantially solvent tight and liquid tight. The holding device is a stopper that can be inserted under friction into an end region of the tube.

The substance thus remains fresh at least as far as the pinch fold. For further use the tube can be cut off upstream of the pinch fold. Although the tube is thus somewhat shortened, the can is nevertheless still usable. The holding device holds the pinch fold in its folded-over position in which it is solvent-tight and moisture-tight, and in this respect is not only liquid-tight but also vapor-tight. The invention includes the following additional advantageous features:

The tube is smooth-walled at least on the inside. Through this feature it is ensured that optimum tightness is achieved in respect to both vapor and liquid.

The tube can be bent back over itself with insubstantial manual force. Through this feature, no special devices are required for folding back the tube, for which purpose the hand power of even a child may be sufficient.

The tube has a circular, annular cross-section at least in an end region and a starting region of the tube. Through this feature tightness is achieved in these regions in a simple manner and indeed without any special means, such as for example clips, simply through the peripheral tension of the tube, without the latter having to be oversized at any point.

The tube is of plastic material, which is resilient and flexible. Through this feature, tube material that is obtainable everywhere will be suitable and that the tube will at least to a substantial extent resume its former approximately straight condition. The outlet end of the tube is then always substantially at the same point.

At least the region of the pinch fold is resilient. Through this feature, the region of the pinch fold restores the tube at least substantially to its original position, and for this purpose no special objects, such as for example (rods or splints) are needed.

The region of the pinch fold regains substantially the full cross-section of the tube when the tube is returned to a straight condition. Through this feature the amount of substance delivered at the outlet remains the same within usable limits.

Tubes of ordinarily Commercially available material, such as previously used for tubes, have provided good results when the tube has an outside dimension of 6.5 mm plus or minus 3 mm. Tubes which are too thin give rise to the risk that the outside layer of the fold may tear. If the tube is too thick, corrugation may occur in the two outer regions of the fold, or else in the middle region, whereby tightness may be reduced or even eliminated.

The tube may have an outside dimension of 6.5 mm plus 4 mm minus 2 mm. The wall cross-sectional area of the tube is smaller than the inside cross-sectional area of the tube. Advantageously, the ratio of inside cross-sectional area to wall cross-sectional area is less than 2. These features further optimize the configuration of the device.

The tube is of plastic material. This material is outstanding in respect to cost, cuttability, resilience, application of peripheral tension and price.

These properties are further optimized when the tube is of polyethylene or polypropylene.

The tube may have a preset fold point. The manufacturer can determine where the preset fold point is to be situated. The part which is folded back is thus prevented from being too short.

The preset fold point is a change in condition of the tube that extends transversely to the longitudinal direction of the tube. This ensures that no special devices are required at the preset fold point.

The change in condition of the tube at the preset fold point is brought about by pressure and/or heat. This can be obtained in a simple manner.

The tube is of thermal plastic material the change in condition of the tube can be achieved in a simple manner by means of heat.

The holding device provides at least partly positive holding. This makes it possible to use simpler holding devices. They are simpler because holding devices that make a connection by friction or by integration of material can only be produced in a more complicated manner.

The holding device is reusable. Only a single holding device is needed.

The holding device is firmly secured on the outlet connection piece. The holding device can be used repeatedly.

The stopper can be inserted into the tube at least substantially vapor-tightly and liquid-tightly. It thus is also unnecessary to cut-off the tube downstream of the pinch fold. To the contrary, the tube always retains the same length.

The stopper can be inserted into the end region of the tube by widening the tube and causing it to seal. Tightness is achieved in the end region of the tube and this solvent-tightness is then maintained at least throughout the period of use.

The holding device is integral with the operating device. The holding device can be produced together with the operating device in a single mould by the injection moulding process.

The holding device is mounted to the outlet connection piece and is situated at a short distance from the outlet connection piece. The holding device is not a hinderance during operation and causes the tube to fold back substantially over half its length.

The stopper points in the same direction as the outlet connection piece. The tube is folded over only once, namely at the pinch fold. Just as the tube is mounted to point away from the operating device, when folded over at the pinch fold it can point back again towards the operating device.

The stopper is substantially shorter than the outlet connection piece. The stopper can be small, requires little material and when it is pushed into the tube it does not displace much material in the tube, so that there is no tendency for the contents of the tube to push the stopper out again.

The preset pinch fold point is positioned to accommodate the length of the portion of the tube from the preset fold point to the holding device. Thus, it is not necessary to test what length one part of the tube must have relative to the other, to ensure that the stopper is correctly inserted into the end region of the tube.

The stopper is connected to the operating device by a preset spacer. Thus the stopper is provided together with the operating device so that it cannot subsequently be lost.

DESCRIPTION OF THE DRAWINGS

The invention will now be explained with reference to a preferred embodiment. In the drawings:

FIG. 3 is a representation on a larger scale of the detail 3 in FIG. 2;

FIG. 4 is a view in the direction of the arrow in FIG. 3;

FIG. 5 is an enlarged side view of a portion of FIG. 1, but without the tube; and FIG. 6 shows the region of a preset fold point.

DETAILED DESCRIPTION OF A PREFERRED EMBODIMENT

Figure 1:
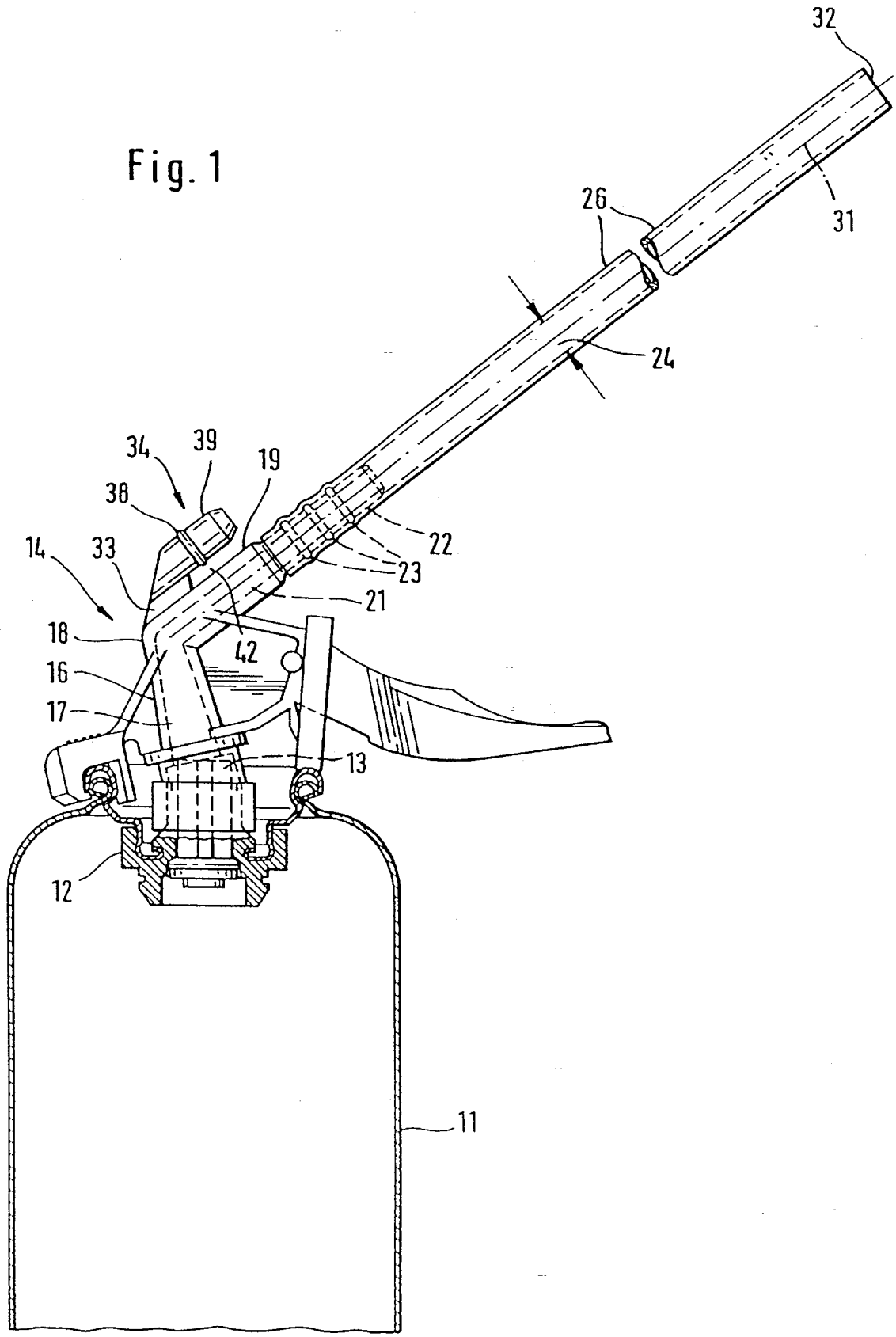
FIG. 1 is a side view of a device according to the invention with the tube extended, partly in section.

In accordance with FIG. 1, a can 11, shown broken away, has a valve 12 on whose stem 13 an operating device 14 is mounted solvent-tightly as shown in FIG. 3 of European Patent Application 91 114 634.8. The operating device 14 acts in the same manner as in the above referenced European Patent Application. The top part of the stem 13 is inserted solvent-tightly into a downwardly directed connection piece 16, which is open towards the bottom and has an approximately frustoconical shape and a similarly shaped interior space 17. After an obtuse-angled bend 18, said connection piece merges integrally into a second connection piece 19, and the interior space 17 continues as a through bore 21. The connection piece 19 is followed, with the continuation of the through bore 21, by a connection extension 22 which is integral therewith and which has a length approximately equal to that of the connection piece 19. The connection extension 22 has a plurality of continuous coaxial, circumferential sealing beads 23, of which there are three in the exemplary embodiment, and whose outside diameter is larger than the inside diameter 24 of a tube 26 of plastics material. The dimension is so selected that the sealing beads 23 widen the bottom region (in FIG. 1) of the plastics tube 26 with a force which produces tightness.

A bevel 27 facilitates the pushing-on of the plastics tube 26. It is followed by a portion 28, so that the latter first coaxially continues the plastics tube 26. Only then is the first sealing bead 23 provided, followed by two further sealing beads, until the bottom end face of the plastics tube 26 strikes against an annular stop 29 and then automatically assumes its intended position.

The sealing beads 23 are spaced apart such that between them the plastics tube 26 can contract again and almost or completely reassumes its previous inside diameter 24, so that in respect of sealing the one sealing bead cannot "see" the other. The plastics tube 26 thus extends in a slightly corrugated form on the connection extension 22.

The plastics tube 26 is cut off in such a manner that at its top end it also has a coaxial end face 32 perpendicular to the geometrical longitudinal axis 31.

In the bottom region, at the top of the connection piece 19, a stopper device 34 is integrally moulded by means of a thin fin 33 and has substantially the shape of a circular cylinder in relation to a geometrical longitudinal axis 36 extending parallel to the longitudinal axis 31. In the folded-back state the top end face 37 is a stop surface for the end face 32. The end face 37 is set back so far from a sealing bead 38 that sufficient wall material of the plastics tube 26 still exists shortly after the end face 32 for the tube still to be able to contract on the left of the sealing bead 38.

The sealing bead 38 is coaxial to the longitudinal axis 36 and has a diameter such that it can there sealingly but reversibly widen the plastics tube 26. There are thus substantially no permanent deformations impairing this function. Like the sealing beads 23, the sealing bead 38 has the same approximately semicircular cross-section over its entire periphery. A guide cylinder 39, which ends in a slide-on bevel 41, is provided as an extension of the sealing bead 38. With the aid of the slide-on bevel 41 the end face 32 of the plastics tube 26 is easily fitted on the guide cylinder 39. The latter does not yet widen the plastics tube 26, because it has at most a diameter matching the inside diameter 24. Universal tightness is provided solely by the sealing bead 38. The stopper device 34 is obviously solid and has no through bore. The guide cylinder 39 provides preliminary guiding, so that the region behind the end face 32 of the tube cannot be pushed too obliquely onto the stopper device 34.

The external periphery of the sealing bead 38, of the guide cylinder 39 and also of the bevelled, semicircular body situated on the left of the sealing bead 38, is so large that between them and the uppermost region of the connection piece 19 a sufficiently large gap 42 is left for the wall thickness of the plastics tube 26.

Figure 2:
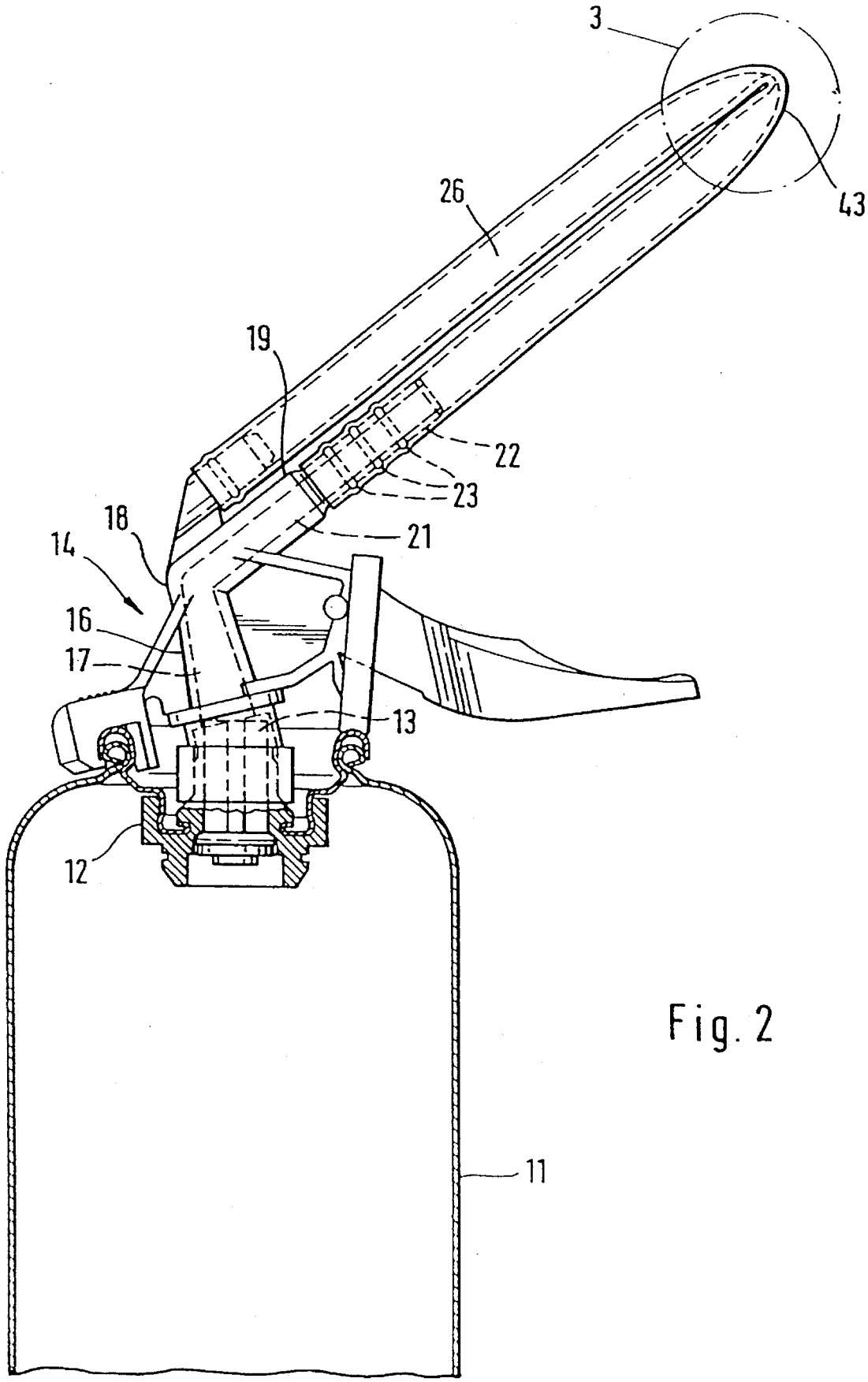
FIG. 2 is a view like FIG. 1, but with approximately half of the tube folded back over itself, and with a stopper inserted.

When the end face 32 is pushed onto the stopper device 34, a pinch fold 43 is formed, as shown in FIG. 2, because of the sufficiently great inherent stiffness of the plastics tube 26. This means that over a certain angular distance there of about 3° to 10° the one half of the wall layer 44 lies on the other half of the wall layer 46. A very tightly folded gusset 47 is thus formed, and it is only below it that the surfaces of the plastics tube 26 come into contact with each other again at the point 48.

FIG. 3 shows how large the (fully adequate) sealing surface 49 is. Although its width is not the same at all points, it does not anywhere drop to zero. In the places where the small arcs 51A, 52A are situated, the tube wall lies on the outside. Even this fold is surprisingly vapour-tight, and in principle the stopper device 34 would consequently not be necessary if it were decided to cut off the plastics tube 26 upstream of the pinch fold 43 before a second use.

As shown in FIG. 6, a preset fold point 51 does not greatly change the plastics tube 26. An external depression 52 at right angles to the geometrical longitudinal axis 31 continues as a smaller bulge 53, under which a smaller depression 54 is also provided. This preset fold point 51 can be produced mechanically and/or thermally and does not for the present case alter the structure of the plastics tube 26. The effect is however achieved that, given correct positioning of the preset fold point 51, the correct lengths of the portions of the plastics tube 26 are dictated and the free end rests substantially without tension on the stopper device 34.

In relation to the volume of the appertaining portion length of the plastics tube 26, the guide cylinder 39 is so short that it gives rise to substantially no compression at that point.

By "vapour-tight" is understood tightness relative to all kinds of vapours contained in the can and to all harmful vapours occurring in the atmosphere, particularly water vapour.

I claim:

1. A device for a region of cans held under propellant pressure where liquid to pasty substances containing solvent pass from said region, comprising:

an operating device for delivering said substances, an outlet connection piece with an end region, on said operating device, a tube made of vapor-tight material having an end region and at least one region that is resilient and flexible, which tube is mounted vapor-tight on said end region of said outlet connection piece, wherein a) said tube can be bent back over itself into a bent back over position to form a pinch fold;

b) a holding device is connected to said outlet connection piece to hold said tube in said bent back over position, said tube being detachable by hand from said holding device;

c) said pinch fold is substantially solvent-tight and liquid-tight; and d) said holding device comprises a stopper that can be inserted under friction into said end region of said tube.

2. The device according to claim 1, wherein said tube is smooth-walled at least inside.

3. The device according to claim 1, wherein said tube can be bent back over itself by insubstantial manual force.

4. The device according to claim 1, wherein said tube has a starting region and a circular, annular cross-section at least in said end region and said starting region of said tube.

5. The device according to claim 1, wherein said tube is of plastics material.

6. The device according to claim 1, wherein at least said pinch fold is resilient.

7. The device according to claim 6, wherein said pinch fold regains substantially its tubular cross-section when said tube is straightened from said bent back over position.

8. The device according to claim 1, wherein said tube has an outside dimension of 6.5 mm plus or minus 3 mm.

9. The device according to claim 1, wherein said tube has an outside dimension of 6.5 mm plus 4 mm minus 2 mm.

10. The device according to claim 1, wherein said tube has a wall cross-sectional area that is smaller than an inside cross-sectional area of said tube.

11. The device according to claim 10, wherein said inside cross-sectional area of said tube has a ratio to said wall cross-sectional area of said tube of less than two to one.

12. The device according to claim 1, wherein said tube is homogeneous.

13. The device according to claim 5, wherein said tube is selected from the group consisting of polyethylene and polypropylene.

14. The device according to claim 1, wherein said tube has a preset fold point.

15. The device according to claim 14, wherein said preset fold point is a change in uniformity of said tube extending transversely to a longitudinal direction of said tube.

16. The device according to claim 15, wherein said change in uniformity of said tube at said preset fold point is brought about by at least one of pressure and heat.

17. The device according to claim 15, wherein said tube is of thermoplastic material.

18. The device according to claim 1, wherein said holding device provides an interface fit with the end of said tube for a positive holding.

19. The device according to claim 1, wherein said holding device is reusable.

20. The device according to claim 1, wherein said holding device is firmly secured on said outlet connection piece.

21. The device according to claim 1, wherein said stopper is connected to said operating device by a preset spacer.

22. The device according to claim 1, wherein said stopper can be inserted at least substantially vapor-tightly and liquid-tightly into said tube.

23. The device according to claim 22, wherein said stopper can be inserted into said end region of said tube widening said tube and causing said tube to seal.

24. The device according to claim 20, wherein said holding device is integral with said operating device.

25. The device according to claim 1, wherein said holding device is mounted on said outlet connection piece and is situated at a short distance from the latter.

26. The device according to claim 1 or 25, wherein said stopper points in the same direction as said outlet connection piece.

27. The device according to claim 22, wherein said stopper is substantially shorter than said outlet connection piece.

28. The device according to claims 14 or 24, wherein said preset fold point is positioned to accommodate a length of a portion of said tube that extends from said preset fold point tube to said holding device.

* * * * *